US008947481B2

(12) United States Patent
Ishii et al.

(10) Patent No.: US 8,947,481 B2
(45) Date of Patent: Feb. 3, 2015

(54) PRINTER, PRINTING CONTROL PROGRAM, AND PRINTING METHOD

(71) Applicant: Brother Kogyo Kabushiki Kaisha, Nagoya (JP)

(72) Inventors: Hidekazu Ishii, Nagoya (JP); Takahiro Miwa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/230,329

(22) Filed: Mar. 31, 2014

(65) Prior Publication Data

US 2014/0354751 A1 Dec. 4, 2014

(30) Foreign Application Priority Data

Jun. 4, 2013 (JP) ..... 2013-118094

(51) Int. Cl.

| | |
|---|---|
| ***B41J 2/35*** | (2006.01) |
| ***B41J 2/32*** | (2006.01) |
| ***B41J 2/315*** | (2006.01) |
| ***B41J 3/407*** | (2006.01) |

(52) U.S. Cl.

CPC ..... *B41J 3/4075* (2013.01)
USPC ..... 347/211; 347/171; 347/221

(58) Field of Classification Search

USPC ..... 347/171, 221, 211
See application file for complete search history.

(56) References Cited

U.S. PATENT DOCUMENTS

2014/0226170 A1* 8/2014 Ishii et al. ..... 358/1.12

FOREIGN PATENT DOCUMENTS

| | | |
|---|---|---|
| JP | 2004-299338 A | 10/2004 |
| JP | 2012-176516 A | 9/2012 |

* cited by examiner

*Primary Examiner* — Sarah Al Hashimi
(74) *Attorney, Agent, or Firm* — Banner & Witcoff, Ltd.

(57) ABSTRACT

The disclosure discloses a printer comprises a print object receiving portion, a first, a second, and a third increment mode receiving portion, a first and a second image generating portion. The print object receiving portion receives an input operation of the print object comprising a print identifier. The first increment mode receiving portion receives a setup operation of the print identifier, an increment interval, and an increment execution count. The first image generating portion generates first printed matter images using a plurality of different types of increment patterns. The second increment mode receiving portion receives a selection operation of the plurality of types of increment patterns. The second image generating portion generates second printed matter images using a plurality of different types of assignment patterns. The third increment mode receiving portion receives a selection operation of any one of the plurality of types of assignment patterns.

6 Claims, 14 Drawing Sheets

PRINTER, PRINTING CONTROL PROGRAM, AND PRINTING METHOD

CROSS-REFERENCE TO RELATED APPLICATION

The present application claims priority from Japanese Patent Application No. 2013-118094, which was filed on Jun. 4, 2013, the disclosure of which is incorporated herein by reference in its entirety.

BACKGROUND

1. Field

The present disclosure relates to a printer, a printing control program, and a printing method that continually produces a plurality of printed matter, each comprising a print object.

2. Description of the Related Art

In the past, there have been known printers that continually produce a plurality of printed matter, each comprising a print object. According to such a printer (label writer), print formation of the print object (characters and symbols) is performed by printing head (a thermal head) on a print-receiving tape (tape) fed by feeder (a tape feeding motor), thereby continually producing a plurality of printed matter (labels), each comprising the print object. The print object includes a print identifier (number) that can be incremented in accordance with a predetermined regularity when the plurality of printed matter is continually produced.

For example, in such a case where an operator can execute various settings in relation to a variety of increments on each of a plurality of print identifiers, multifarious variations of setting combinations per print identifier results. In such a case, if the settings of the content input by the operator him- or herself are executed, the operator finds it difficult to identify the mode in which the printed matter will actually be produced. Further, even in a case where a printed matter image is generated and displayed in advance, if the printed matter image is generated reflecting the settings made by the operator all at once, the possibility exists that the number of printed matter may increase due to unintended break positions, unintended empty blocks may occur in the printed matter of the last sequential number, increments of a mode not in line with the operator's original intention may occur using a synchronizing pattern or alternating pattern, or the like.

SUMMARY

It is therefore an object of the present disclosure to provide a printer, a printing control program, and a printing method capable of quickly and easily producing printed matter incremented by a mode that reliably reflects the intentions of the operator.

In order to achieve the above-described object, according to the aspect of the present application, there is provided a printer comprising a feeder configured to feed a print-receiving tape, a printing head configured to produce at least one printed matter wherein a desired print object is respectively formed on the print-receiving tape, along a transport direction of the feeder, by performing printing of the print object on the print-receiving tape fed by the feeder, a print object receiving portion configured to receive an input operation of the print object comprising a print identifier that can be incremented in accordance with a predetermined regularity and is respectively disposed in a plurality of blocks that can be set in a plurality in a tape length direction in relation to one the printed matter, a setting image generating portion configured to generate a setting image in relation to the printed matter wherein the plurality of blocks, each comprising the print object, is arranged in a tape length direction, based on a reception result of the print object receiving portion, a setting display portion configured to display the setting image generated by the setting image generating portion, a first increment mode receiving portion configured to receive a setup operation of specification of at least one the print identifier to be incremented, an increment interval, and an increment execution count when the print identifier is to be incremented, a first image generating portion configured to respectively generate first printed matter images wherein the print identifier is incremented in accordance with a setup operation received by the first increment mode receiving portion, using a plurality of different types of increment patterns, a first display portion configured to display in list format the first printed matter images using the plurality of types of increment patterns, generated by the first image generating portion, a second increment mode receiving portion configured to receive a selection operation of any one of the plurality of types of increment patterns in relation to the first printed matter images displayed in the list format, a second image generating portion configured to respectively generate second printed matter images wherein the print identifier is incremented in accordance with the setup operation received by the first increment mode receiving portion and for which is used a type of increment pattern received by the second increment mode receiving portion, using a plurality of different types of assignment patterns when the print objects are to be assigned to each printed matter, a second display portion configured to display in list format the second printed matter images using the plurality of types of assignment patterns, generated by the second image generating portion, a third increment mode receiving portion configured to receive a selection operation of any one of the plurality of types of assignment patterns in relation to the second printed matter images displayed in the list format, and a printing control portion configured to control the feeder and the printing head so as to generate at least one the printed matter corresponding to the second printed matter images using the selected assignment pattern, in accordance with the selection operation received by the third increment mode receiving portion.

In the printer of the present disclosure, print formation of a print object is performed by the printing head on a print-receiving tape fed by the feeder, thereby producing at least one printed matter, each comprising the print object (character string, barcode, or the like).

At this time, according to the present disclosure, in order to arrange the print object of each printed matter, a plurality of blocks is set in each printed matter and at least one print object is arranged in each block. Further, according to the present disclosure, the print object comprises a print identifier (a number, letter, or the like, for example) that can be incremented in accordance with a predetermined regularity when the printed matter is produced as described above. When the operator performs an input operation for the print object that includes the print identifier, the input operation is received by the print object receiving portion. When the operation of the operator is thus received, a setting image in which the print object is included in a plurality of blocks is generated by the setting image generating portion and displayed by the setting display portion based on the reception result.

Then, according to the present disclosure, the operator can configure various settings in relation to the increment of the print identifier. That is, the operator can perform setup operations of the print identifier specification (such as the character to be incremented or the like, for example), the increment interval (such as letters in alphabetical order, increasing numbers by twos, or the like, for example), the increment execution count (such as in three stages or the like, for example), the increment pattern (such as a synchronizing pattern in which a plurality of print identifiers is incremented while synchronized, an alternating pattern in which a plurality of print identifiers is individually incremented alternately, or the like, for example), and the assignment pattern in cases where the print object that includes the print identifier is to be assigned to each printed matter, when the print identifier is to be incremented.

In the present disclosure, printed matter images are not displayed by generating images that reflect the various increment related settings made by the operator all at once, but rather by generating images that reflect the settings in stages, requiring verification and selection operations by the operator on a case-by-case basis.

That is, with the setting image displayed by the setting display portion as described above, first, the setup operation of the print identifier specification, increment interval, and increment execution count when the print identifier of the print object included in the printed matter image is to be incremented is received by the first increment mode receiving portion. Then, based on the reception result, first printed matter images in which the print identifier has been incremented in accordance with the received setup operation is generated by the first image generating portion and displayed by the first display portion. At that time, the first printed matter images using each of a plurality of different types of increment patterns are respectively generated and displayed in list format so that the operator can subsequently further select the type of increment pattern to be used.

Then, with the first printed matter images using the plurality of types of increment patterns displayed in list format, a selection operation of any one of the plurality of types of increment patterns is received by the second increment mode receiving portion. Then, based on the reception result, second printed matter images using the received type of increment pattern are generated by the second image generating portion and displayed by the second display portion. At that time, the second printed matter images using each of a plurality of different types of assignment patterns are respectively generated and displayed in list format so that the operator can subsequently further select how each print object is to be assigned to each printed matter (in other words, where a break is to be set per printed matter).

Then, with the second printed matter images using the plurality of types of assignment patterns displayed in list format, a selection operation of any one of the plurality of types of assignment patterns is received by the third increment mode receiving portion.

Subsequently, at least one printed matter corresponding to the selected second printed matter image is produced by a coordination of the feeder and the printing head based on the control of the printing control portion, in accordance with the reception result of the third increment mode receiving portion.

As described above, in the present disclosure, first, with the initial image display (setting images) wherein a print object that includes a print identifier is disposed currently displayed, the setup operation of the print identifier specification, increment interval, and increment execution count made by the operator is received and images reflecting this (first printed matter images) are displayed. Subsequently, the selection of an increment pattern is further received and images reflecting this (second printed matter images) are displayed. Furthermore, subsequently, the selection of an assignment pattern is received and, by a mode reflecting this, printed matter is produced. Thus, increment related settings are received and reflected in displays in stages, little by little, thereby making it possible to quickly and easily produce printed matter that reliably reflects the intentions of the operator. As a result, it is possible to improve convenience for the operator.

DETAILED DESCRIPTION OF THE PREFERRED EMBODIMENTS

Figure 1:
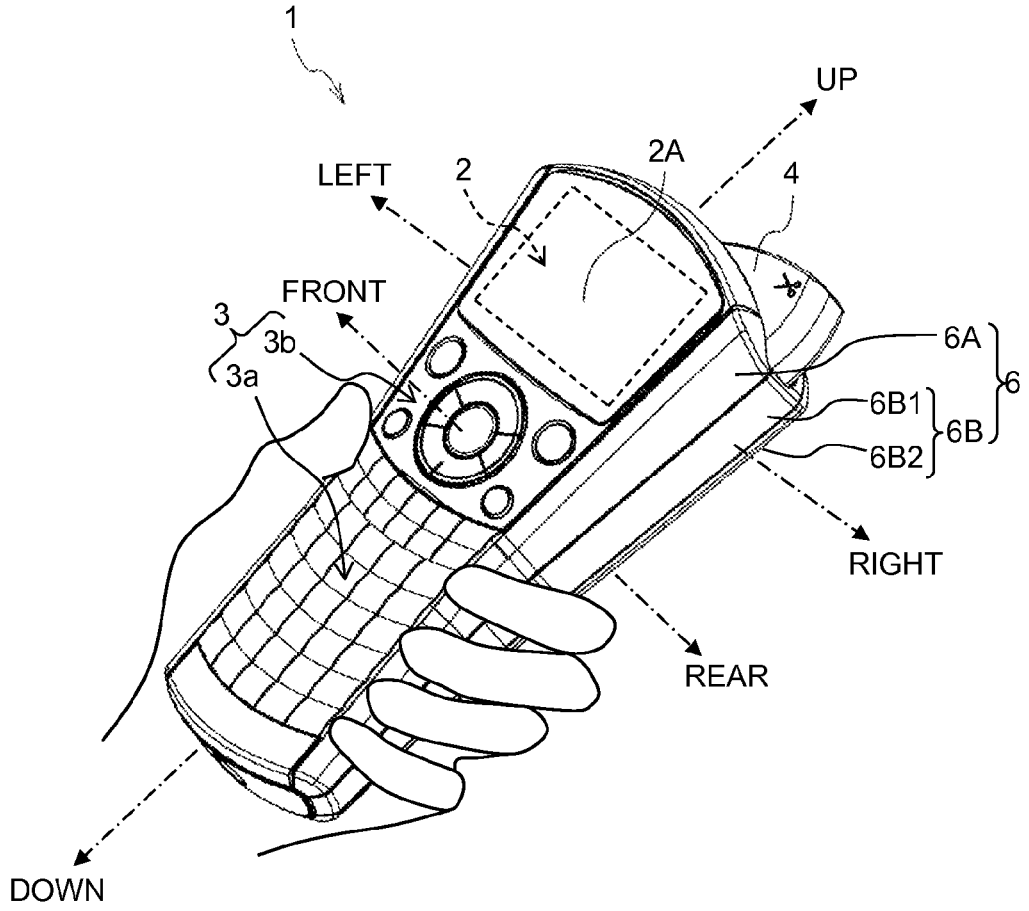
FIG. 1 is a perspective view showing the overall configuration of the print label producing apparatus of an embodiment of the present disclosure.

The following describes an embodiment of the present disclosure with reference to accompanying drawings. This embodiment describes a case that applies the present disclosure to a print label producing apparatus. Note that, in a case where "Front", "Rear", "Left", "Right", "Up", and "Down" are denoted in the drawings, the terms "front", "rear", "left", "right", "up", and "down" in the explanations in the description refer to the denoted directions.

Overall Configuration of the Label Producing Apparatus

First, the overall configuration of the print label producing apparatus of this embodiment will be described with reference to FIG. 1.

As shown in FIG. 1, a print label producing apparatus 1, in this example, is a handheld print label producing apparatus gripped with the hand of an operator. A housing 6 of this print label producing apparatus 1 comprises a front cover 6A that constitutes the apparatus front surface, and a rear cover 6B that constitutes the apparatus rear surface.

A liquid crystal display part 2 for performing various displays is disposed on the upper side of the front cover 6A. The front surface of the liquid crystal display part 2 is covered by a cover panel 2A, made of a transparent acrylic plate, etc., for example. A keyboard 3 for performing various operations is disposed on the lower side of the liquid crystal display part 2. Character keys 3*a* for inputting characters (including symbols and numbers as well) and various function keys 3*b* are included in the keyboard 3.

The rear cover 6B comprises a rear cover main body 6B1 and a removable cover 6B2 that can be removed from the rear cover main body 6B1. A cut button 4 for driving a cutter (not shown) that cuts a label tape 80 with print (refer to FIG. 4 described later) is disposed on the upper right end of the rear cover main body 6B1.

Inner Structure of Label Producing Apparatus

Next, the inner structure of the print label producing apparatus 1 will be described with reference to FIG. 2 and FIG. 3.

Figure 2:
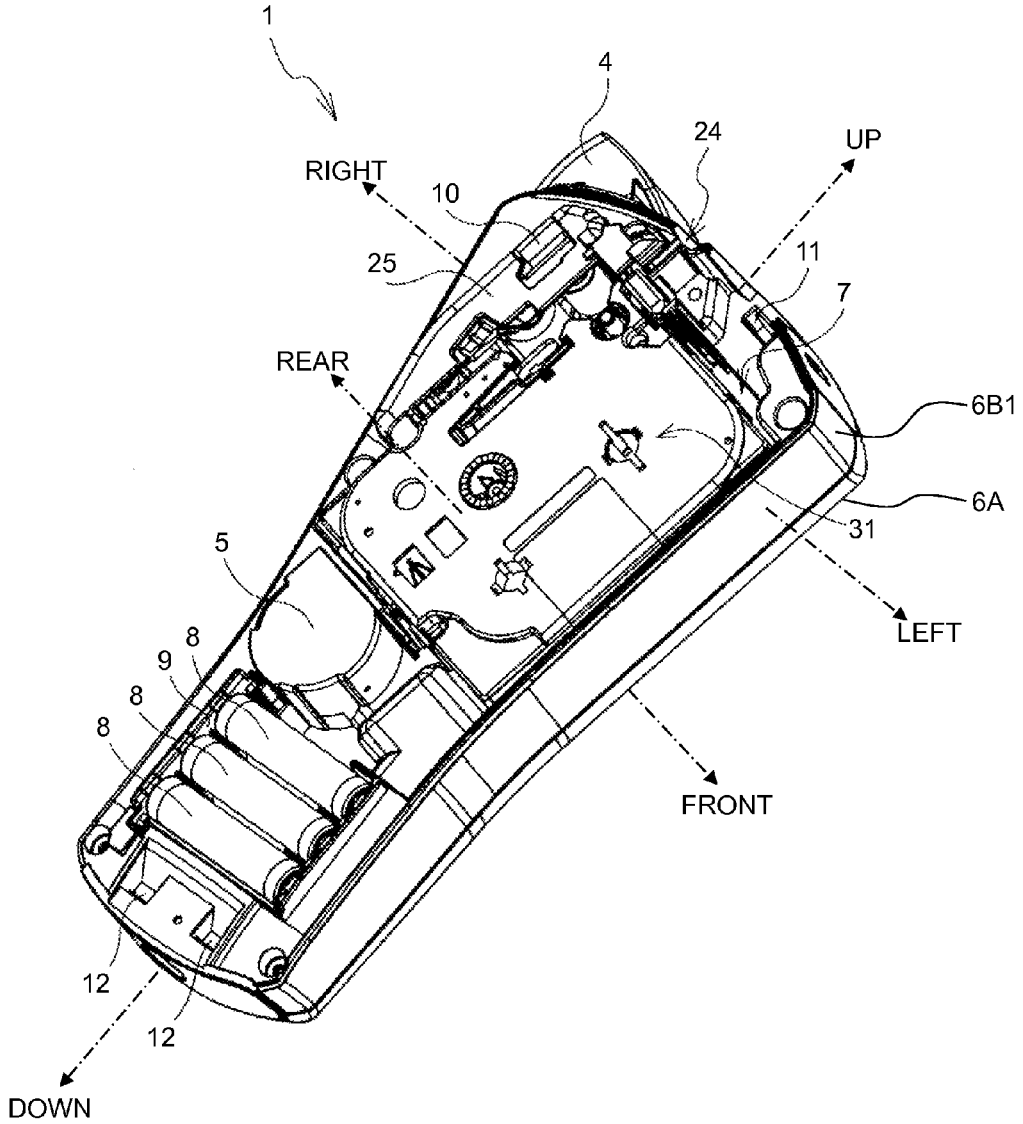
FIG. 2 is a perspective view showing the inner structure of the print label producing apparatus with the removable cover removed and the cartridge mounted to the cartridge holder.
Figure 3:
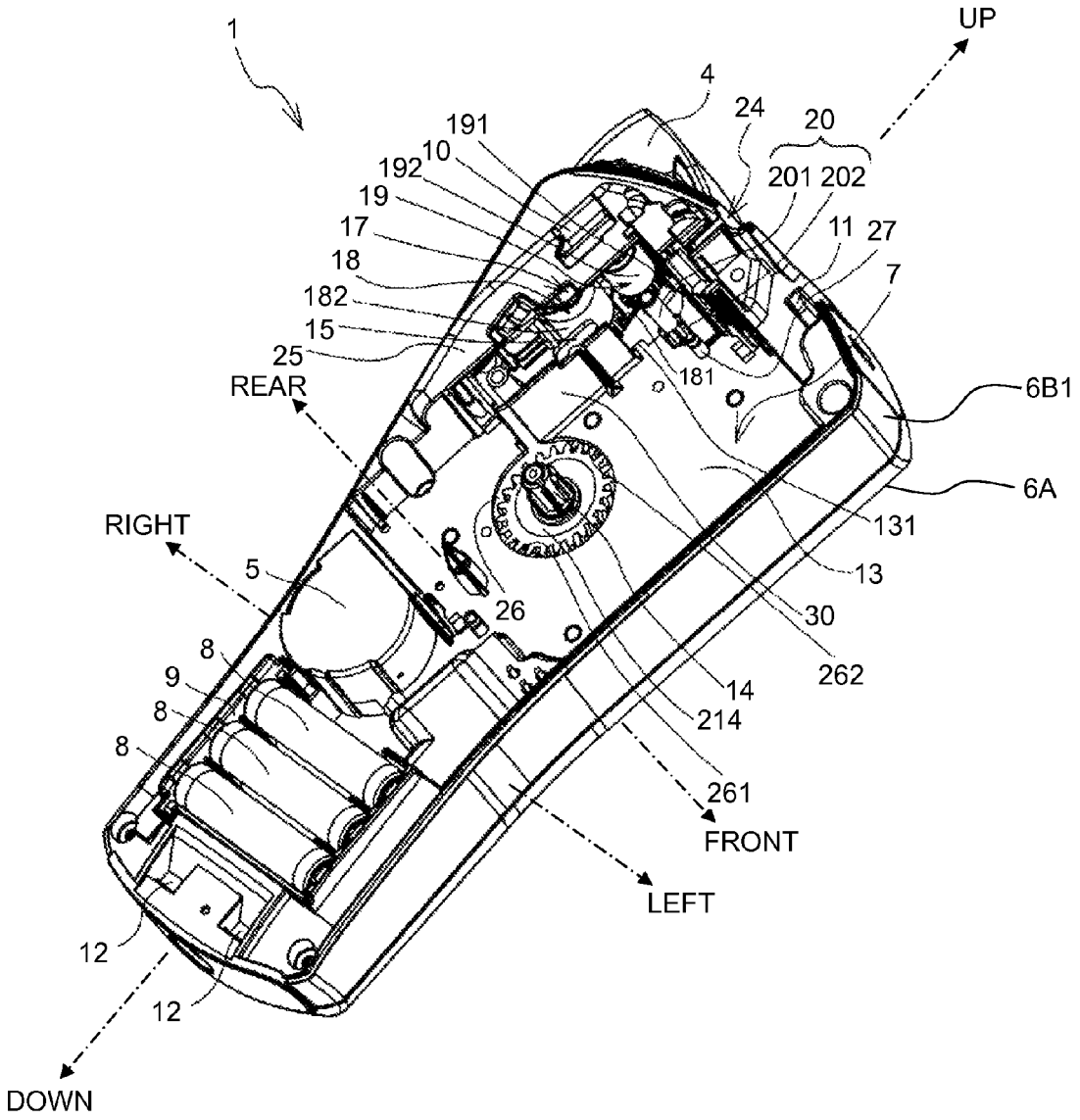
FIG. 3 is a perspective view showing the inner structure of the print label producing apparatus with the removable cover removed and the cartridge removed from the cartridge holder.

As shown in FIG. 2 and FIG. 3, a concave-shaped cartridge holder 7 is disposed on the rear upper portion of the rear cover main body 6B1. A cartridge 31 that supplies a cover film 51 and a base tape 53 (refer to FIG. 4 described later for both) is attached to and removed from the cartridge holder 7.

A motor storage part 5 for storing a motor 21 (refer to FIG. 5 described later) is disposed on the lower side of the cartridge holder 7. A battery storage part 9 for storing a battery 8 is disposed on the lower side of the motor storage part 5, that is, on the lower portion of the rear cover main body 6B1. The motor 21 is driven by the power supplied from the battery 8, and drives a ribbon take-up spool 57, a platen roller 182, and a pressure roller 192 (details of each described later).

A tape discharging slit 24 for discharging the label tape 80 with print to the outside is disposed on the upper side of the cartridge holder 7. Further, a roller holder 17 (details described later) is disposed on the right upper portion of the cartridge holder 7, and a plate part 25 with a plate shape is disposed on the rear side of the roller holder 17. A protruding part insertion hole 10, which is an opening, is disposed on the upper portion of the plate part 25. The removable cover 6B2 is attached to or removed from the rear cover main body 6B1, thereby inserting or removing a protruding part (not shown) disposed on the removable cover 6B2 into or from the protruding part insertion hole 10. With this arrangement, it is possible to move the roller holder 17 to a print position (the position shown in FIG. 4 described later) and to a standby position (not shown).

Further, a lock hole 11 is disposed on the upper end portion and two lock holes 12 are disposed on the lower end portion of the rear cover main body 6B1. When the removable cover 6B2 is installed on the rear cover main body 6B1, lock members (not shown) disposed on the removable cover 6B2 are inserted into the lock holes 11, 12, respectively. With this arrangement, natural release of the removable cover 6B2 is reduced.

The bottom surface of the cartridge holder 7 includes a frame 13. A frame end 131 serving as the right end portion of the frame 13 is further disposed on the right side of a rib 30 and a roller shaft 20 (both described in detail later). A concave-shaped gear indented part 26 is disposed on the substantial center portion of the frame 13, and a gear 214 is disposed in the gear indented part 26. A gear indented part first opening 261 is disposed on the lower side of the gear indented part 26, and a gear indented part second opening 262 is disposed on the upper side of the gear indented part 26. The gear 214 respectively meshes with gears (not shown) respectively disposed on the surface on the front side of the frame 13 via the gear indented part first opening 261 and the gear indented part second opening 262. A ribbon take-up shaft 14 for taking up an ink ribbon 55 (refer to FIG. 4 described later) is arranged in a standing condition on the rear side of this gear 214. With this configuration, the power of the motor 21 is transmitted by the plurality of gears, rotating the gear 214 and the ribbon take-up shaft 14. A gear shaft (not shown) that rotatably supports the gear 214 and a plurality of gears disposed on the surface on the front side of the frame 13 that includes the two gears that mesh with the gear 214 is integrally formed with the frame 13.

Note that, while FIG. 3 shows the teeth of the gear 214 exposed for ease of explanation, the structure is designed so that the teeth of the gear 214 are actually covered by an umbrella part (not shown) for concealment and not exposed.

Figure 4:
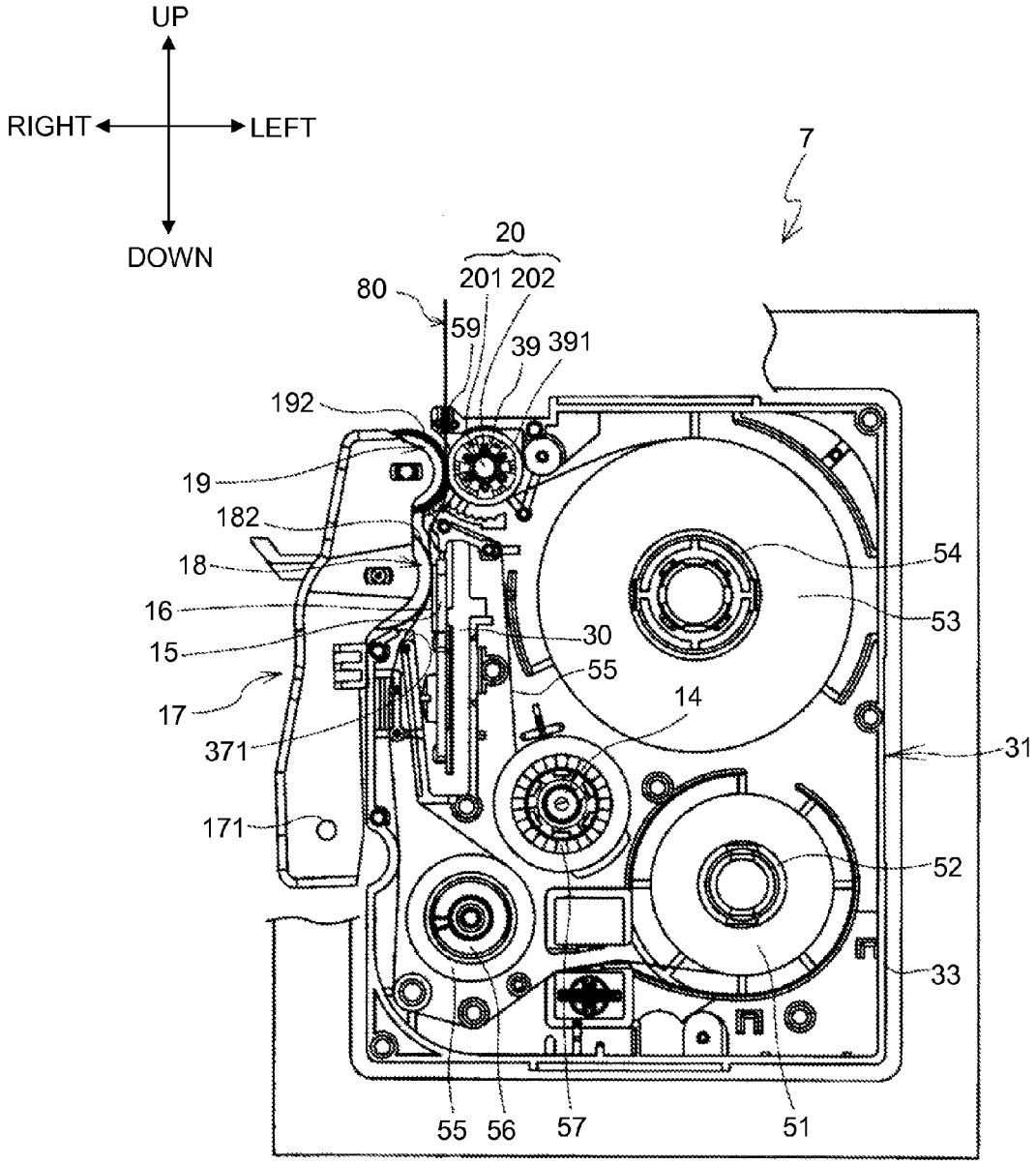
FIG. 4 is a plan view showing the inner structure of the cartridge.

The rib 30 is arranged in a standing condition on the right side of the ribbon take-up shaft 14 (refer to FIG. 4 as well). A rectangular-shaped heat sink 15 is disposed on the right side surface of the rib 30. A thermal head 16 (refer to FIG. 4 described later) comprising a plurality of heating elements is disposed on the right side surface of the heat sink 15.

Further, the roller shaft 20 is arranged in a standing condition on the frame 13, between the rib 30 and the tape discharging slit 24. The roller shaft 20 is integrally formed with the frame 13. This roller shaft 20 comprises a cylinder-shaped cylinder part 201, and six ribs 202 formed radially from the outer periphery of the cylinder part 201 toward the outside (refer to FIG. 4 described later as well). Further, the roller shaft 20 is inserted into a shaft hole 391 (refer to FIG. 4 described later) of a feeding roller 39 disposed on the cartridge 31, and rotatably supports the feeding roller 39. A convex part 27 is arranged in a standing condition on the left side of the roller shaft 20. The convex part 27 is inserted into a concave part (not shown) of the cartridge 31, thereby positioning the cartridge 31 in the front-rear direction.

Inner Structure of Cartridge

Next, the inner structure of the cartridge 31 will be described with reference to FIG. 4.

As shown in FIG. 4, a cover film spool 52 around which is wound the transparent film-shaped cover film 51 (print-receiving tape) is rotatably disposed on the lower left portion inside a cartridge case 33 of the cartridge 31 mounted to the cartridge holder 7. The cover film 51 fed out from the cover film spool 52 is guided toward a cartridge opening 371, and fed from the cartridge opening 371.

A ribbon spool 56 around which is wound the ink ribbon 55 is rotatably disposed on the lower right portion inside the cartridge case 33. The ink ribbon 55 fed out from the ribbon spool 56 is guided toward the cartridge opening 371, and fed along with the cover film 51 from the cartridge opening 371.

The ribbon take-up spool 57 is rotatably disposed between the cover film spool 52 and the ribbon spool 56. The gear 214 to which the power was transmitted from the motor 21 rotates, thereby rotating the ribbon take-up shaft 14 arranged in a standing condition on the rear side of the gear 214 and rotating the ribbon take-up spool 57. With this arrangement, the ink ribbon 55 is pulled out from the ribbon spool 56, and the consumed ink ribbon 55 is taken up.

A base tape spool 54 around which is wound the base tape 53 is rotatably disposed on the upper portion inside the cartridge case 33. The base tape 53 fed out from the base tape spool 54 is guided toward the feeding roller 39 and pressed with the cover film 51 with print by the feeding roller 39 and the pressure roller 192 (details described later) to form the label tape 80 with print, which is then fed toward a tape discharging exit 59.

Further, the arm-shaped roller holder 17 comprising a platen roller unit 18 and a pressure roller unit 19 is disposed on the right side of the cartridge 31 mounted to the cartridge holder 7 so that it is rockable in the left-right direction around a shaft support part 171 (refer to FIG. 3 as well). When the removable cover 6B2 is installed, the roller holder 17 is moved in the cartridge 31 direction by the protruding part. With this arrangement, the pressure roller unit 19 and the platen roller unit 18 disposed on the roller holder 17 move to a print position (the position shown in FIG. 4).

The platen roller unit 18 is disposed on the right side of the heat sink 15. The platen roller 182 and a platen roller gear 181 (refer to FIG. 3) are disposed on this platen roller unit 18. The platen roller 182 is disposed in a position facing the thermal head 16 disposed on the right side surface of the heat sink 15. The thermal head 16 prints a print object, such as a desired character string (including one character) or a barcode (including both a one-dimensional source code and a two-dimensional source code), on the cover film 51 fed by the platen roller 182, the pressure roller 192, and the like. The platen roller gear 181 is meshed with the gear (not shown) disposed on the front side of the frame 13 and, with the power transmitted from the motor 21, rotates, thereby rotating the platen roller 182. With this arrangement, when the platen roller unit 18 moves to the print position, the platen roller 182 feeds the cover film 51 with print in the direction of the pressure roller unit 19 by the rotation thereof while pressing the cover film 51 and the ink ribbon 55 against the thermal head 16.

The pressure roller 192 and a pressure roller gear 191 (refer to FIG. 3) are disposed on the pressure roller unit 19. The pressure roller 192 is disposed in a position facing the roller shaft 20. The pressure roller gear 191 is meshed with the gear (not shown) disposed on the front side of the frame 13 and, with the power transmitted from the motor 21, rotates, thereby rotating the pressure roller 192. With this arrangement, when the pressure roller unit 19 moves to the print position, the pressure roller 192 presses the cover film 51 and the base tape 53 against the feeding roller 39 rotatably supported by the roller shaft 20. With this arrangement, the cover film 51 with print and the base tape 53 are pressed and form the label tape 80 with print, which is then discharged from the tape discharging exit 59 to the outside of the cartridge 31. Subsequently, the label tape 80 with print is guided toward the tape discharging slit 24 and discharged from the tape discharging slit 24 to the outside of the print label producing apparatus 1.

Control System of the Label Producing Apparatus

Next, the control system of the print label producing apparatus 1 will be described with reference to FIG. 5.

Figure 5:
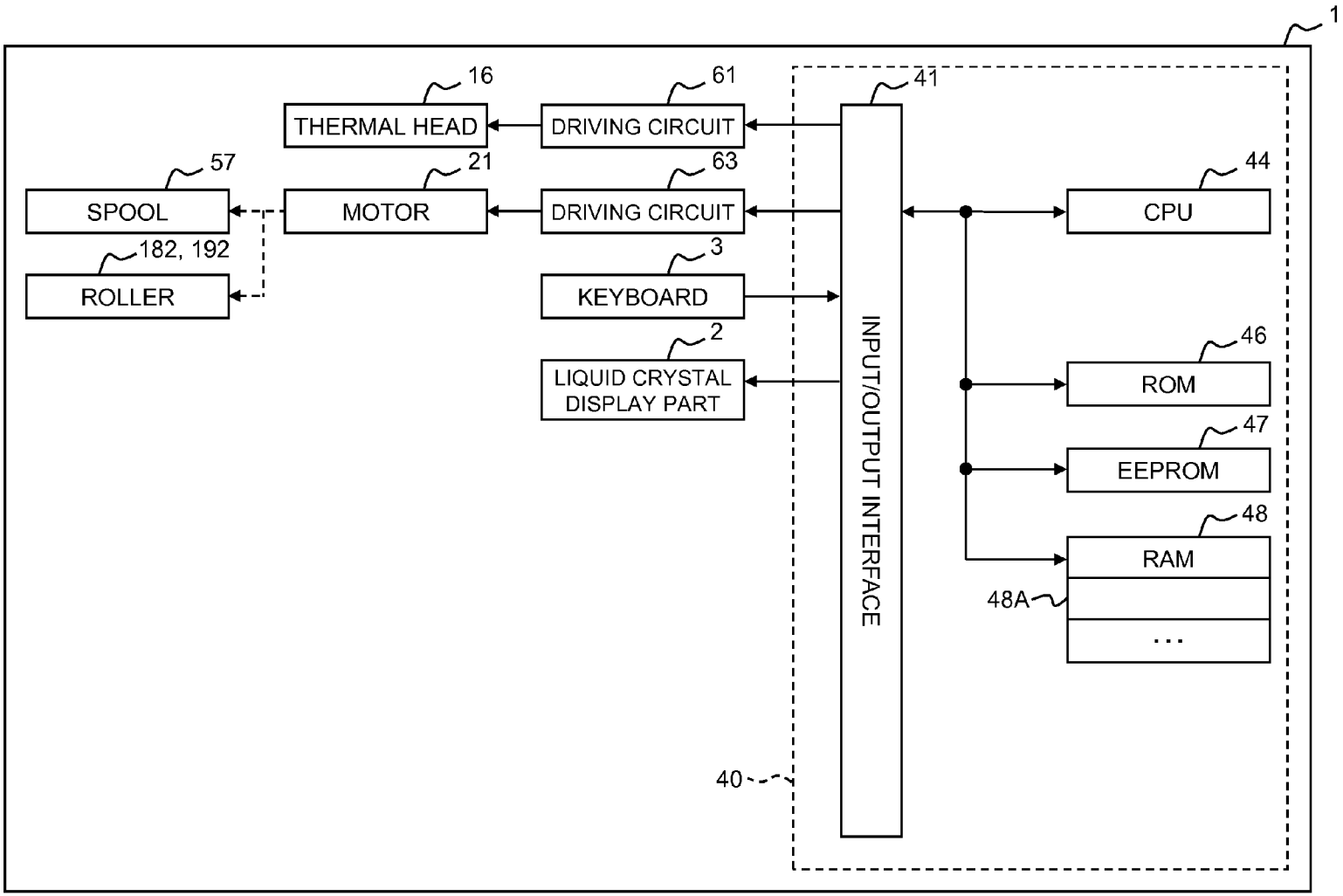
FIG. 5 is a block diagram showing the control system of the print label producing apparatus.

As shown in FIG. 5, a control circuit 40 is disposed on a control board (not shown) of the print label producing apparatus 1. A CPU 44 is disposed on the control circuit 40, and a ROM 46, a RAM 48, an EEPROM 47, and an input/output interface 41 are connected to the CPU 44 via a data bus. Note that nonvolatile memory such as flash memory may be used in place of the EEPROM 47.

Various programs (such as a printing control program that executes the respective steps of FIG. 11 and FIG. 12 described later, for example) required for controlling the print label producing apparatus 1 are stored in the ROM 46. The CPU 44 performs various operations based on the various programs stored in this ROM 46.

The RAM 48 temporarily stores various operation results from the CPU 44. A label image memory 48A and the like are disposed on this RAM 48.

The EEPROM 47 stores various information.

A thermal head driving circuit 61, a motor driving circuit 63, the keyboard 3, the liquid crystal display part 2, and the like are connected to the input/output interface 41.

The thermal head driving circuit 61 drives the thermal head 16.

The motor driving circuit 63 drives the motor 21, thereby rotating the gear 214. The gear 214 then rotates, rotating the ribbon take-up shaft 14, which in turn rotates the ribbon take-up spool 57. Further, the rotation of the gear 214 is transmitted to the platen roller gear 182 and the pressure roller gear 191, and the platen roller gear 182 and the pressure roller gear 191 then rotate, rotating the platen roller 182 and the pressure roller 192.

In such a control system wherein the control circuit 40 serves as the core, when the operator inputs a predetermined label production instruction via the keyboard 3, the platen roller 182, the pressure roller 192, and the like are driven via the motor driving circuit 63 and the motor 21, and the cover film 51 and the like are fed. Further, in synchronization with this, a plurality of heating elements of the thermal head 16 is selectively heated and driven via the thermal head driving circuit 61, and printing of the print object is performed on the fed cover film 51. With this arrangement, in the end, a print label wherein the print object is formed on the cover film 51 is produced.

Example of Print Label

Figure 6:
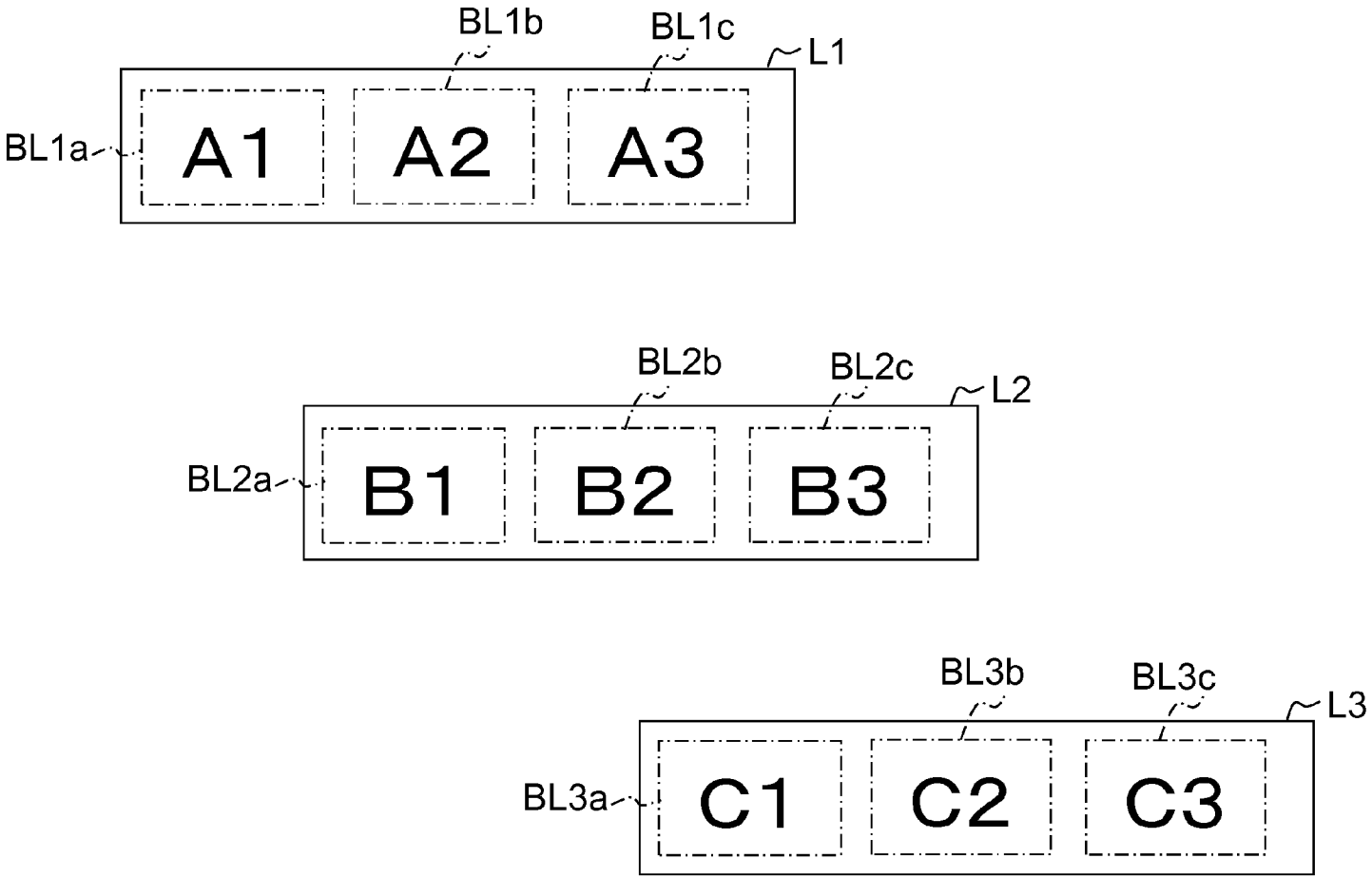
FIG. 6 is a plan view showing an example of the outer appearance of a produced print label.

Hence, the print label producing apparatus 1 is capable of continually producing a plurality of print labels in a predetermined order along the transport direction of the platen roller 182, the pressure roller 192, and the like. FIG. 6 shows a plurality of (three in these example) print labels L1, L2, L3 thus produced.

According to this embodiment, a plurality of blocks BL for arranging the print object comprising a character string, barcode, or the like is arranged on the respective print labels L in the tape length direction. Then, one print object is disposed in the respective blocks. In the example shown in FIG. 6, three blocks BL1a-BL1c are disposed on the print label L1, and a character string "A1", a character string "A2", and a character string "A3" are respectively disposed on the blocks BL1a, BL1b, BL1c. Three blocks BL2a-BL2c are disposed on the print label L2, and a character string "B1", a character string "B2", and a character string "B3" are respectively disposed on the blocks BL2a, BL2b, BL2c. Three blocks BL3a-BL3c are disposed on the print label L3, and a character string "C1", a character string "C2", and a character string "C3" are respectively disposed on the blocks BL3a, BL3b, BL3c.

Further, as shown in FIG. 6, according to this embodiment, the character strings of the respective blocks include a print identifier that can be incremented in accordance with a predetermined regularity when a plurality of print labels (the three print labels L1, L2, L3 in this example) is continually produced as described above. That is, in this example, the letters "A" "B" "C" and numbers "1" "2" "3" are print identifiers. The letters "A" "B" "C" are incremented one by one from "A"→"B"→"C" in accordance with the production sequence of the print label L1→print label L2→print label L3. The numbers "1" "2" "3" are incremented one by one from "1"→"2"→"3" in accordance with the block sequence on the respective print labels L1, L2, L3.

Special Characteristics of the Embodiment

Then, according to this embodiment, when the print labels L1-L3 such as described above are produced, the various settings made by the operator that pertain to the increments of the character strings are received and correspondingly displayed. At that time, in this embodiment, label images are not displayed by generating images that reflect the various settings made by the operator all at once, but rather by generating images that reflect the settings in stages (a setting image and a label image exist; details described later) are generated and displayed, requiring a verification or selection operation by the operator on a case-by-case basis. In the following, details on the functions will be described in order.

Generating the Setting Image

First, when the operator performs a quantity setup operation for the blocks of one print label (for example, "2" in this example; note that the number may differ from the number of blocks of the produced print label L due to the existence of break settings described later) via the keyboard 3 with a suitable initial settings screen (not shown) used for editing displayed on the liquid crystal display part 2, the setup operation is received. Subsequently, when the operator performs an input operation for the print objects, which include the print identifiers respectively disposed in the received quantity of blocks, via the keyboard 3, the input operation is received. According to this embodiment, a setting image in relation to one print label L is generated and displayed on the liquid crystal display part 2 based on the reception result.

Figure 7A:
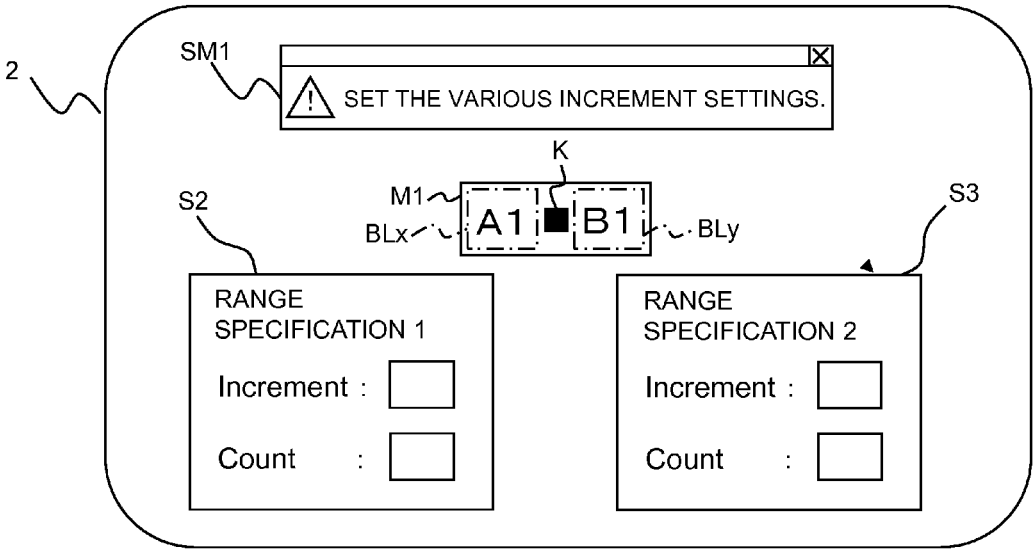
FIG. 7A is an explanatory view showing a display example when various increment related settings are received.

For example, in the example shown in FIG. 7A, the quantity of blocks of one print label is set to "2" as described above, and the character string "A1" is input as the print object in a first block BLx while the character string "B1" is input as the print object in a second block BLy displayed as a result. With this arrangement, a setting image M1 of one print label L, which includes the character strings "A1" "B1", is displayed on the liquid crystal display part 2. Note that a new block mark K is displayed between the two blocks BLx, BLy.

Then, according to this modification, the increment related settings made by the operator are set for the first block BLx. At this time, the range of print identifiers (a letter and number in this example) to be incremented that is specifiable by the operator is two. In other words, two print identifiers to be incremented are available for selection. Accordingly, as shown in FIG. 7A, an increment mode specification area S2 and an increment mode specification area S3 are displayed on the left and right sides below the setting image M1. In the increment mode specification areas S2, S3, an "Increment" box that permits input of an increment interval setting which indicates the size of one increment, and a "Count" box that permits input of an increment execution count setting are respectively displayed.

Note that the message, "Set the various increment settings" is displayed in a setting instruction message area SM1 above the setting image M1 on the liquid crystal display part 2.

Figure 7B:
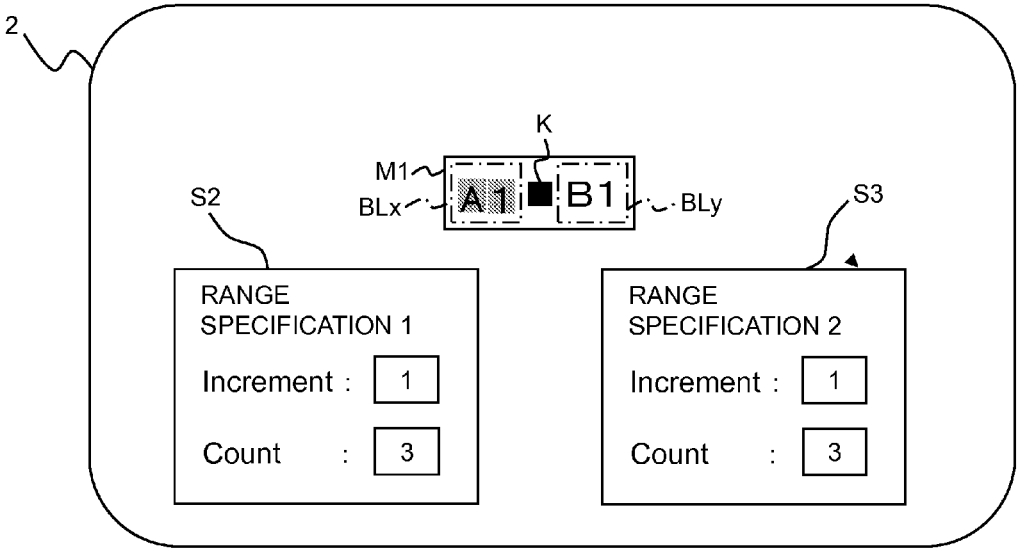
FIG. 7B is an explanatory view showing a display example when various increment related settings are received.

As shown in FIG. 7B, in this example, both the character "A" and the character "1" included in the character string "A1" of the block BLx are specified as the range of print identifiers to be incremented (refer to the shaded areas). Then, in the increment mode specification area S2, the character "A" is set to an increment interval of 1 by the "Increment" box, and to an increment execution count of 3 by the "Count" box. Similarly, the character "1" is set to an increment interval of 1 by the "Increment" box, and to an increment execution count of 3 by the "Count" box.

Generating First Label Images

Figure 8:
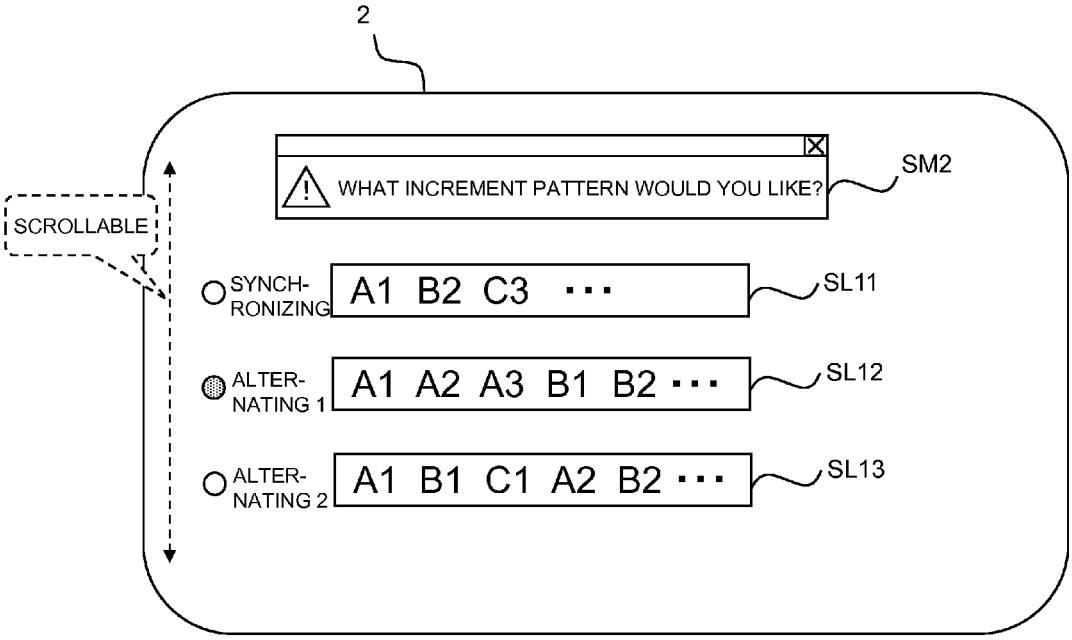
FIG. 8 is an explanatory view showing a display example of label images that use a plurality of types of increment patterns.

When the increment interval and increment execution count settings for each of the characters "A" "B" of the setting image M1 are completed as described above, label images incremented by a mode reflecting these settings are generated and displayed on a preview screen of the liquid crystal display part 2, as shown in FIG. 8. At that time, label images using each of a plurality of different types of increment patterns are respectively generated and displayed in list format so that the operator can subsequently further select the type of increment pattern to be used.

Hence, according to this embodiment, the two patterns of the "synchronizing pattern" and "alternating pattern" are prepared as the increment patterns. The synchronizing pattern is a pattern that increments a plurality of print identifiers of the setting image M1 in synchronization. The alternating pattern is a pattern that individually increments a plurality of print identifiers of the setting image M1 alternately.

Thus, in this example, as shown in FIG. 8, a label image SL11 of "A1 B2 C3 . . . " that reflects the increment interval and increment execution count settings for the aforementioned characters "A" "1" using the synchronizing pattern is first displayed in the uppermost area along with a "Synchronizing" checkbox. Further, label images that reflect the increment interval and increment execution count settings for the aforementioned characters "A" "1" using the alternating patterns are also displayed thereunder. At that time, two patterns, namely the pattern (first alternating pattern) A1, A2, A3, B1, B2, B3 . . . and the pattern (second alternating pattern) A1, B1, C1, A2, B2, C2 . . . , are conceivable as the increment of the alternating pattern based on the characters "A" "1". Accordingly, a label image SL12 of "A1 A2 A3 B1 B2 B3 . . . " is displayed along with an "Alternating 1" checkbox, and a label image SL13 of "A1 B1 C1 A2 B2 C2 . . . " is displayed along with an "Alternating 2" checkbox.

Note that the message, "What increment pattern would you like?" appears in a setting instruction message area SM2 above the label images SL11, SL12, SL13 on the liquid crystal display part 2. Further, the entire display screen shown in FIG. 8 is scrollable in the up-down direction by a suitable operation (an operation using the keyboard 3, for example; the same holds true for FIG. 9, FIG. 10, FIG. 13, and FIG. 14 described later as well).

Generating Second Label Images

Figure 9:
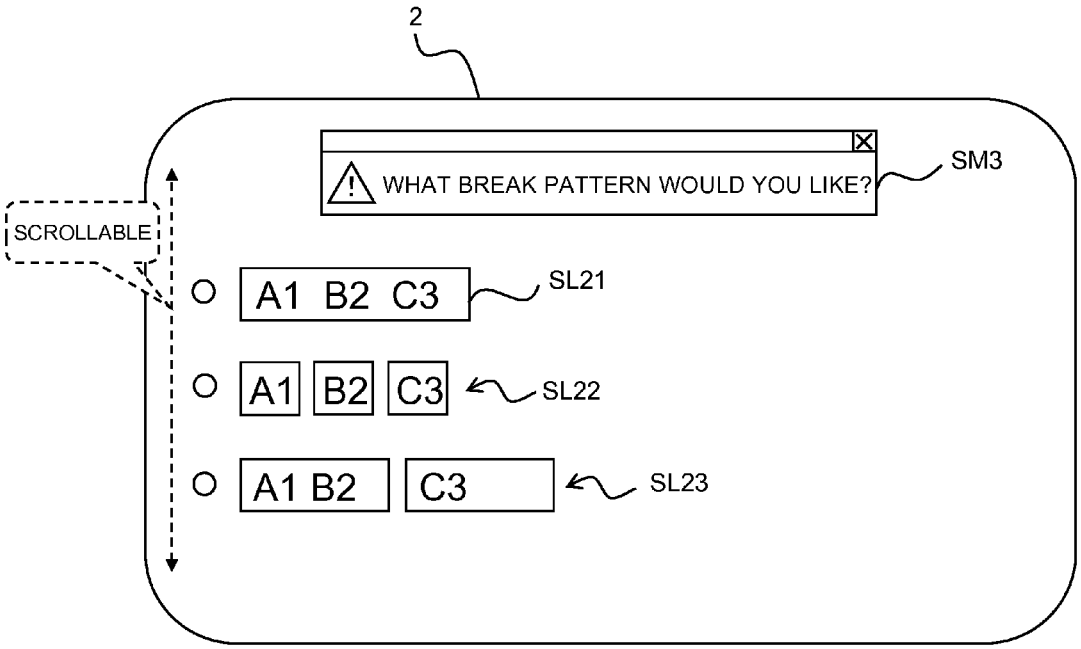
FIG. 9 is an explanatory view showing a display example of label images that use a plurality of types of break patterns when a synchronizing pattern is selected as the increment pattern.
Figure 10A:
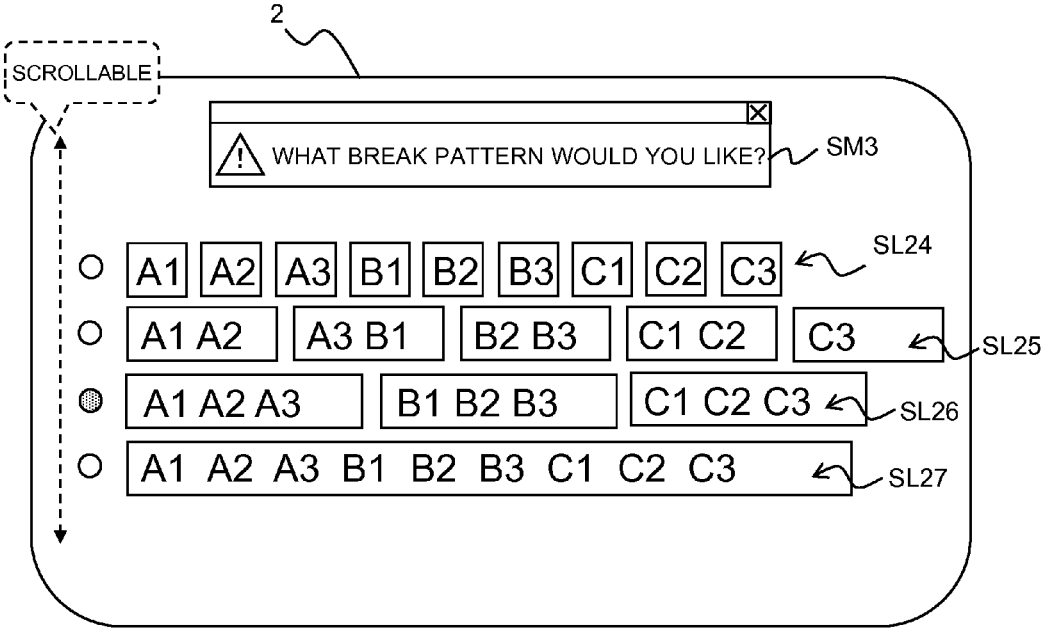
FIG. 10A is an explanatory view showing a display example of label images that use a plurality of types of break patterns when an alternating pattern is selected as the increment pattern.
Figure 10B:
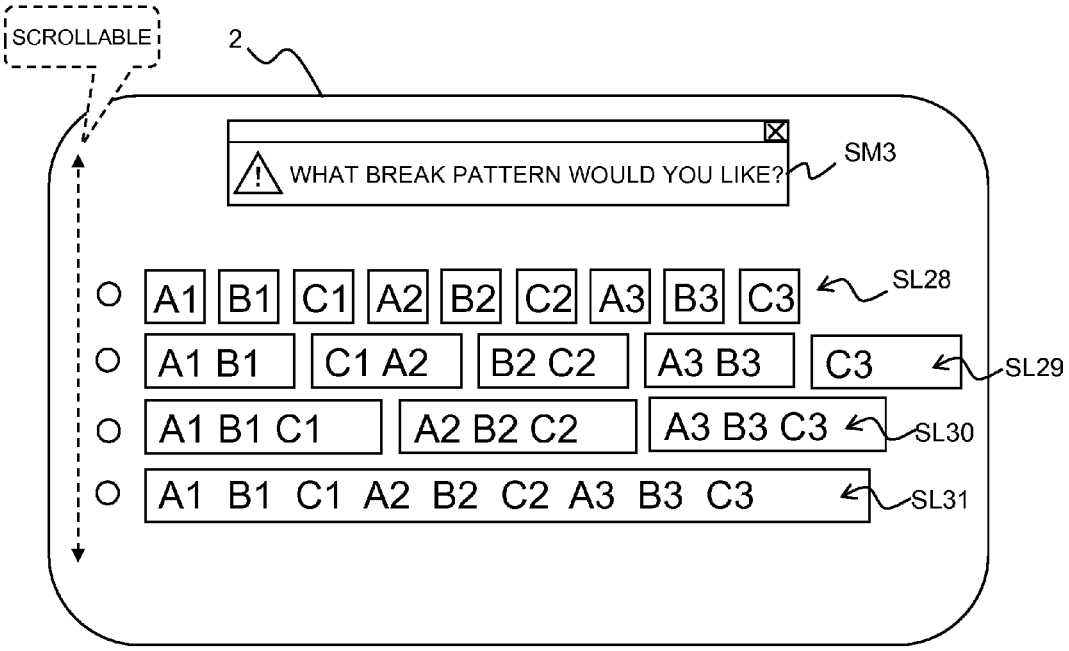
FIG. 10B is an explanatory view showing a display example of label images that use a plurality of types of break patterns when an alternating pattern is selected as the increment pattern.

When any one of the label images SL11, SL12, SL13 using the plurality of types of increment patterns is selected when displayed in list format as described above, label images of the selected increment pattern are generated and displayed on the preview screen of the liquid crystal display part 2, as shown in FIG. 9, FIG. 10A, and FIG. 10B. At that time, label images using each of a plurality of different types of break patterns (in other words, assignment patterns) are respectively generated and displayed in list format so that the operator can subsequently further select the break pattern to be used (in other words, how the character strings are to be assigned to the respective print labels).

For example, the example shown in FIG. 9 is an example of a case where the "synchronizing pattern" is selected on the display screen of the FIG. 8. In this example, a label image SL21 with the respective character strings included in the label image SL11 not at all separated by breaks as in "A1 B2 C3" (in other words, the character strings are included in one print label) is displayed along with a checkbox. Thereunder, a label image SL22 with the respective character strings included in the label image SL11 separated one by one by breaks as in "A1" "B2" "C3" (in other words, one print label is established per character string) is displayed along with a checkbox. Furthermore, thereunder, a label image SL23 with the respective character strings included in the label image SL11 separated per predetermined quantity (in this case, separated two by two) by breaks as in "A1 B2" "C3" is displayed along with a checkbox.

Further, the example shown in FIG. 10A is an example of a case where the "First alternating pattern" is selected on the display screen of the FIG. 8. In this example, a label image SL24 with the respective character strings included in the label image SL12 separated one by one by breaks as in "A1" "A2" "A3" "B1" "B2" B3" "C1" "C2" "C3" (in other words, one print label is established per character string) is displayed along with a checkbox. Further, thereunder, a label image SL25 with the respective character strings included in the label image SL12 separated per predetermined quantity (in this case, separated two by two) by breaks as in "A1 A2" "A3 B1" "B2 B3" "C1 C2" "C3" is displayed along with a checkbox. Furthermore, thereunder, a label image SL26 with the respective character strings included in the label image SL12 separated into three by breaks as in "A1 A2 A3" "B1 B2 B3" "C1 C2 C3" (in other words, three print labels are established) is displayed along with a checkbox. Further, thereunder, a label image SL27 with the respective character strings included in the label image SL12 not at all separated by breaks as in "A1 A2 A3 B1 B2 B3 C1 C2 C3" (in other words, the character strings are included in one print label) is displayed along with a checkbox.

Furthermore, the example shown in FIG. 10B is an example of a case where the "Second alternating pattern" is selected on the display screen of the FIG. 8. In this example, a label image SL28 with the respective character strings included in the label image SL13 separated one by one by breaks as in "A1" "B1" "C1" "A2" "B2" C3" "A3" "B3" "C3" (in other words, one print label is established per character string) is displayed along with a checkbox. Further, thereunder, a label image SL29 with the respective character strings included in the label image SL13 separated per predetermined quantity (in this case, separated two by two) by breaks as in "A1 B1" "C1 A2" "B2 C2" "A3 B3" "C3" is displayed along with a checkbox. Furthermore, thereunder, a label image SL30 with the respective character strings included in the label image SL13 separated into three by breaks as in "A1 B1 C1" "A2 B2 C2" "A3 B3 C3" (in other words, three print labels are established) is displayed along with a checkbox. Further, thereunder, a label image SL31 with the respective character strings included in the label image SL13 not at all separated by breaks as in "A1 B1 C1 A2 B2 C2 A3 B3 C3" (in other words, the character strings included in one print label) is displayed along with a checkbox.

Note that the message, "What break pattern would you like?" is displayed in a setting instruction message area SM3 above the label images on the liquid crystal display part 2 shown respectively in the FIG. 9, FIG. 10A, and FIG. 10B.

Then, with the label images SL21-SL31 using the plurality of types of break patterns displayed in list format on any one of the screens shown in FIG. 9, FIG. 10A, and FIG. 10B as described above, any one of the types of break patterns is selected, thereby making it possible to execute print formation by the thermal head 16 according to the mode corresponding to the selected label image and produce the corresponding number of print labels L. For example, when the first alternating pattern is selected as shown in the FIG. 8 and the break pattern of the label image SL26 shown in FIG. 10 is further selected on the display screen subsequently displayed, it is possible to produce three print labels, namely the print label L1 where the character string "A1 A2 A3" is disposed, the print label L2 where the character string "B1 B2 B3" is disposed, and the print label L3 where the character string "C1 C2 C3" is disposed, as shown in the aforementioned FIG. 6 (note that the cutting between the respective print labels is performed by the operator operating the cut button 4 when the feeding of the label tape 80 with print stops at the cutting position, as described later).

Control Steps

Figure 11:
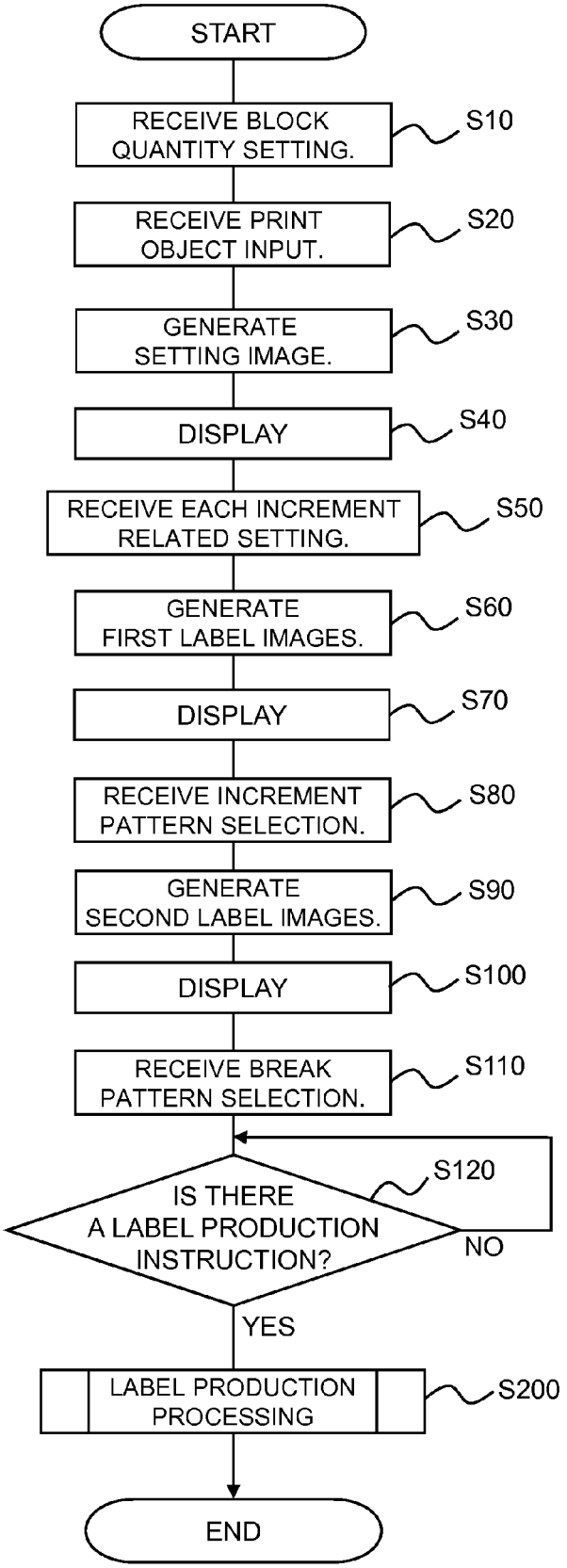
FIG. 11 is a flowchart showing the control steps executed by the CPU.
Figure 12:
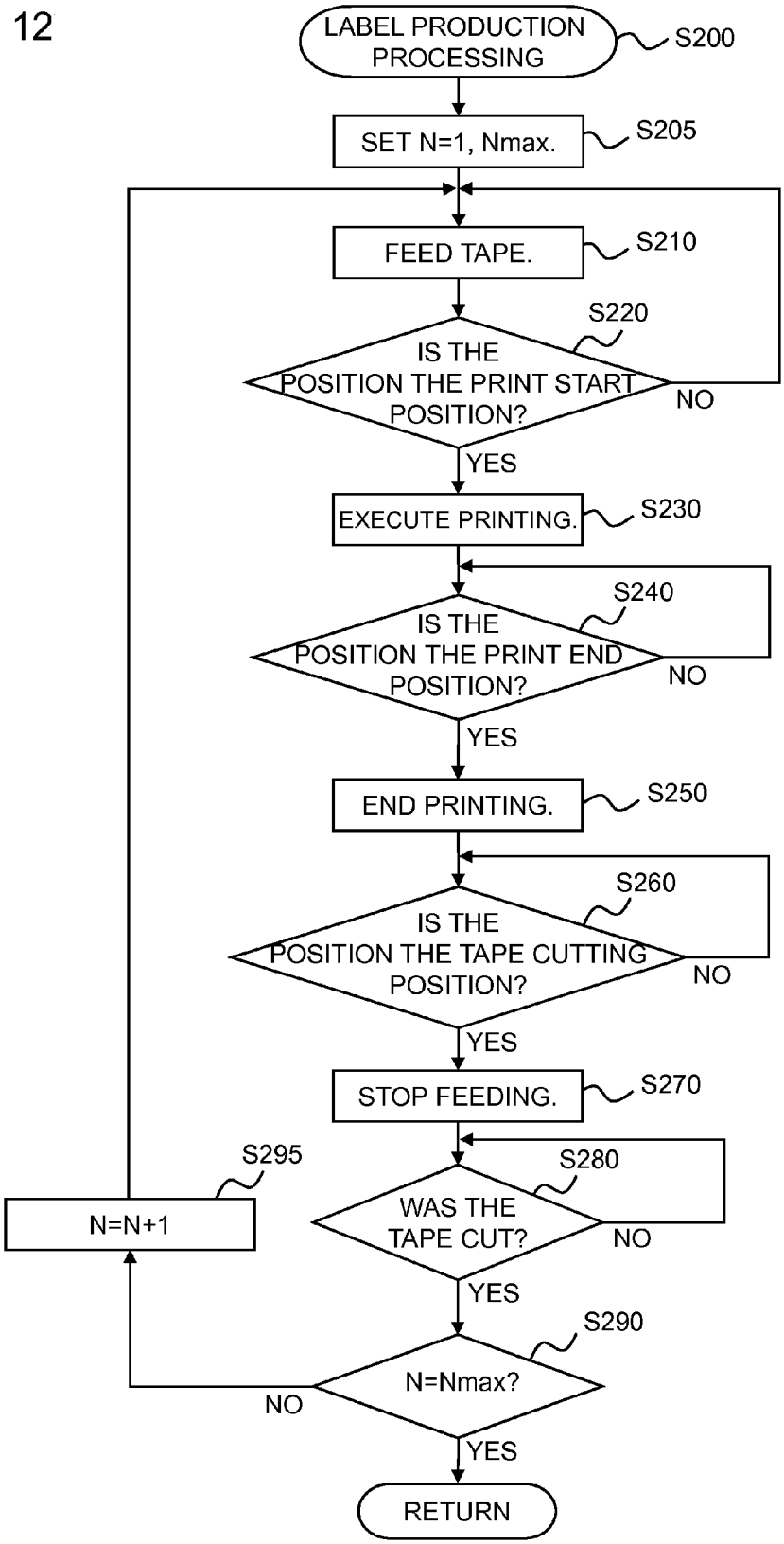
FIG. 12 is a flowchart which shows the detailed procedure of step S200.

The following describes the control steps of the printing method executed by the CPU 44 of the label producing apparatus 1 for achieving the technique, using the flowcharts of FIG. 11 and FIG. 12.

In FIG. 11, the processing shown by this flow is started by turning the power supply of the print label producing apparatus 10N, for example.

First, in step S10, the CPU 44 receives a quantity setup operation for the blocks per one print label L, performed by the operator via the keyboard 3 with the aforementioned initial settings screen used for editing displayed.

Subsequently, the flow proceeds to step S20 where the CPU 44 receives an input operation for the print objects, such as a character string or the like (including the letters and numbers to be incremented), to be respectively disposed in the quantity of blocks (the two blocks BLx, BLy in the aforementioned example) received in the step S10, via the keyboard 3.

Subsequently, the flow proceeds to step S30 where the CPU 44 generates the single setting image M1 wherein the quantity of blocks received in the step S10, respectively comprising the print objects received in the step S20, is arranged in the tape length direction.

Then, in step S40, the CPU 44 displays the setting image M1 generated in the step S30 on the liquid crystal display part 2 (refer to FIG. 7A and FIG. 7B).

Subsequently, the flow proceeds to step S50 where the CPU 44 receives the setup operation in relation to the increment made by the operator via the keyboard 3. Note that the setup operation in relation to the increment of the print label received in this step S50 includes operations such as setup of the print identifier to be incremented (range setup), setup of the increment interval, setup of the increment execution count, and the like, as described above.

Then, in step S60, the CPU 44 generates at least one label image (the three label images SL1, SL2, SL3 in the above described example) in which the plurality of print identifiers (the character "A" and the character "1" in the above described example) to be incremented in the setting image M1 is incremented by the increment mode based on the respective increment related settings received in the step S50 using a plurality of types of increment patterns.

Subsequently, the flow proceeds to step S70 where the CPU 44 displays the label images (the label images SL11, SL12, SL13 in the above described example) using the plurality of types of increment patterns generated in the step S60 on the liquid crystal display part 2 (refer to FIG. 8).

Then, in step S80, the CPU 44 receives the selection of any one of the plurality of types of increment patterns made by the operator via the keyboard 3 (in other words, the selection of any one of the label images SL1-SL3).

Subsequently, in step S90, the CPU 44 generates label images using the type of increment pattern received in step S80 according to a plurality of types of break patterns (generates the label images SL21-SL23, the label images SL24-SL27, or the label images SL28-SL31 in the above described example).

Then, in step S100, the CPU 44 displays the label images using the plurality of types of increment patterns generated in the step S90 (the label images SL21-SL23, the label images SL24-SL27, or the label images SL28-SL31 in the above described example) on the liquid crystal display part 2.

Subsequently, in step S110, the CPU 44 receives the selection of any one of the plurality of types of break patterns made by the operator via the keyboard 3 (in other words, the selection of any one of the label images SL21-SL31).

Then, in step S120, the CPU 44 determines whether or not a predetermined label production instruction was input via the keyboard 3. Until the label production instruction is input, the condition of step S120 is not satisfied (S120: NO), and the flow loops back and enters a standby state. Once a label production instruction is input, the condition of step S120 is satisfied (S120: YES), and the flow proceeds to step S200.

In step S200, the CPU 44 executes label production processing (details described later) in which the print label L corresponding to the label image for which the break pattern was received in the step S110 is produced. The processing indicated in this flow then terminates here.

The detailed steps of the label production processing of the step S200 will now be described using FIG. 12.

In FIG. 12, first, in step S205, the CPU 44 sets the value of a variable N in relation to the number of print labels L to be produced to 1. Further, at the same time, the CPU 44 sets a maximum value Nmax of the variable N in accordance with the selection of the break pattern received in the step S110 (in other words, selection of any one of the label images SL21-SL31).

Subsequently, in step S210, the CPU 44 outputs a control signal to the motor driving circuit 63 and starts the driving of the motor 21. As a result, the gear 214 is rotationally driven, the rotation of the platen roller 182, the pressure roller 192, and the like is started, and the feeding of the cover film 51, the base tape 53, and the label tape 80 with print is started.

Subsequently, the flow proceeds to step S220 where the CPU 44 determines whether or not the transport direction position of the cover film 51 has arrived at a desired print start position by a known technique. Until the transport direction position arrives at the print start position, the condition of step S220 is not satisfied (S220: NO), the flow returns to the step S210, and the same step is repeated. Once the transport direction position arrives at the print start position, the condition of step S220 is satisfied (S220: YES), and the flow proceeds to step S230.

In step S230, the CPU 44 outputs a control signal (print data) in accordance with the label of the sequential number corresponding to the value of the variable N at the moment in any one of the label images SL21-SL23 displayed as in FIG. 9 (or any one of the label images SL24-SL27 displayed as in FIG. 10A, or any one of the label images SL28-SL31 displayed as in FIG. 10B) in the step S100, to the thermal head driving circuit 61. As a result, the thermal head 16 is driven in accordance with the print data, and formation of the print object corresponding to the print data is started on the cover film 51.

Then, in step S240, the CPU 44 determines whether or not the transport direction position of the cover film 51 has arrived at a desired print end position by a known technique. Until the transport direction position arrives at the print end position, the condition of step S240 is not satisfied (S240: NO), and the flow loops back and enters a standby state. Once the transport direction position arrives at the print end position, the condition of step S240 is satisfied (S240: YES), and the flow proceeds to step S250.

In step S250, the CPU 44 outputs a control signal to the thermal head driving circuit 61, and stops the driving of the thermal head 16 to terminate printing.

Subsequently, the flow proceeds to step S260 where the CPU 44 determines whether or not the transport direction position of the label tape 80 with print has arrived at the tape cutting position by a known technique. Until the transport direction position arrives at the tape cutting position, the condition of step S260 is not satisfied (S260: NO), and the flow loops back and enters a standby state. Once the transport direction position arrives at the tape cutting position, the condition of step S260 is satisfied (S260: YES), and the flow proceeds to step S270.

In step S270, the CPU 44 outputs a control signal to the motor driving circuit 63 and stops the driving of the motor 21. As a result, the rotation of the platen roller 182, the pressure roller 192, and the like stops, and the feeding of the cover film 51, the base tape 53, and the label tape 80 with print stops.

Then, in step S280, the CPU 44 determines whether or not the cutter was driven and the label tape 80 with print was cut by operation of the cut button 4. Until the label tape 80 with print is cut, the condition of step S280 is not satisfied (S280: NO), and the flow loops back and enters a standby state. Once the label tape 80 with print is cut, the condition of step S280 is satisfied (S280: YES), and the flow proceeds to step S290. Note that, with the cutting of the label tape 80 with print, the print label L of the sequential number corresponding to the value of the variable N at the moment is produced based on any one of the label images SL21-SL23 displayed as in FIG. 9 (or any one of the label images SL24-SL27 displayed as in FIG. 10A, or any one of the label images SL28-SL31 displayed as in FIG. 10B) in the step S100.

In step S290, the CPU 44 determines whether or not the value of the variable N has reached the maximum number Nmax. Until the value of the variable N reaches the maximum number Nmax, the condition of step S290 is not satisfied (S290: NO) and the flow proceeds to step S295. In step S295, the CPU 44 adds 1 to the value of the variable N, the flow returns to the step S210, and the same steps are repeated. On the other hand, once the value of the variable N reaches the maximum number Nmax, the condition of step S290 is satisfied (S290: YES), and this routine is terminated. With the above, the entire number of the print labels L corresponding to any one of the label images SL21-SL23 displayed as in FIG. 9 (or any one of the label images SL24-SL27 displayed as in FIG. 10A, or any one of the label images SL28-SL31 displayed as in FIG. 10B) in the step S100 is produced.

As described above, in this embodiment, first, with the initial image display (setting image M1) wherein a print object that includes a print identifier is disposed currently displayed, the setup operation of the print identifier specification, increment interval, and increment execution count made by the operator is received, and images reflecting this (the label images SL11-SL13) are displayed. Subsequently, the selection of the increment pattern is further received, and the images reflecting this (the label images SL21-SL23, SL24-27, or SL28-SL31) are displayed. Furthermore, subsequently, the selection of a break pattern is received and, by a mode reflecting this, the print label L is produced. Thus, the reception and reflected display of increment related settings are performed in stages, little by little, making it possible to quickly and easily produce the print label L that reliably reflects the intentions of the operator. As a result, it is possible to improve convenience for the operator.

Further, in particular, according to this embodiment, the label image SL11 that uses the synchronizing pattern, and the label images SL12, SL13 that use the alternating pattern are displayed in list format on the screen shown in FIG. 8. With this arrangement, the operator can select whether the print identifier is to be incremented using the synchronizing pattern or the alternating pattern upon visual recognition of the label states when the respective patterns are executed, in accordance with his or her own intentions.

Note that the present disclosure is not limited to the above described embodiment, and various modifications may be made without deviating from the spirit and scope of the disclosure. The following describes such modifications.

(1) when the Increment Pattern is Displayed with Priority in Accordance with History While the label image SL11 of the synchronizing pattern, the label image SL12 of the first alternating pattern, and the label image SL13 of the second alternating pattern are displayed in that order from the upper area to the lower area as shown in FIG. 8 in the embodiment, for example, the present disclosure is not limited thereto. That is, the display order may be changed in accordance with the selection history of the increment pattern when used during label production in the past, and the pattern selected the previous time (or the pattern with a greater amount of history), for example, may be displayed with priority. In this case, the history is stored in the EEPROM 47 of the control circuit 40, for example, described above.

Figure 13:
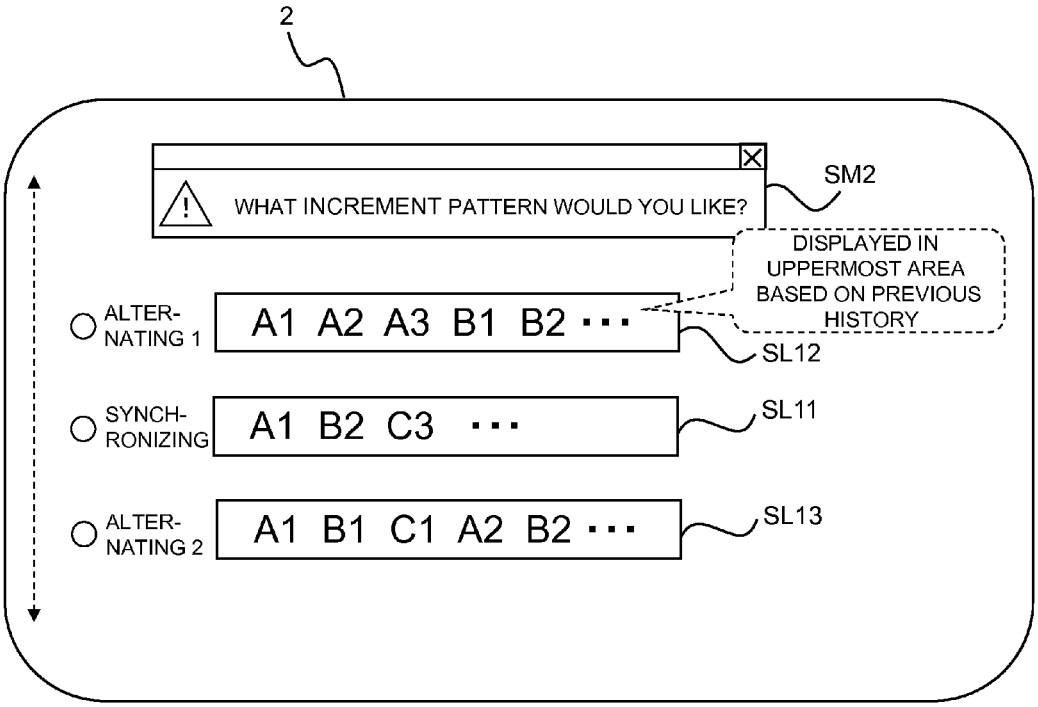
FIG. 13 is an explanatory view showing a display example of label images that use a plurality of types of increment patterns in a modification where the increment patterns are displayed with priority in accordance with history.

For example, FIG. 13 shows a case where the label image SL12 of the first alternating pattern, the label image SL11 of the synchronizing pattern, and the label image SL13 of the second alternating pattern are displayed in that order from the upper area to the lower area in accordance with the selection history described using the FIG. 8 (the first alternating pattern of the three increment patterns was selected).

In this modification, the increment patterns that the operator utilized in the past are thereafter displayed with a higher priority than the other patterns on the preview screen of the liquid crystal display part 2. As a result, the operator can easily select the increment pattern once again, thereby improving operator convenience in this manner as well.

(2) when the Break Pattern is Displayed with Priority in Accordance with History While, for example, the label images SL21, SL22, SL23 are displayed in that order per break pattern from the upper area to the lower area in the example shown in FIG. 9, the label images SL24, SL25, SL26, SL27 are displayed in that order per break pattern from the upper area to the lower area in the example shown in FIG. 10A, and the label images SL28, SL29, SL30, SL31 are displayed in that order per break pattern from the upper area to the lower area in the example shown in FIG. 10B in the embodiment, the present disclosure is not limited thereto. That is, the display order may be changed in accordance with the selection history of the break pattern when used during label production in the past, and the pattern selected the previous time (or the pattern with a greater amount of history), for example, may be displayed with priority. In this case, the history is stored in the EEPROM 47 of the control circuit 40, for example, described above.

Figure 14:
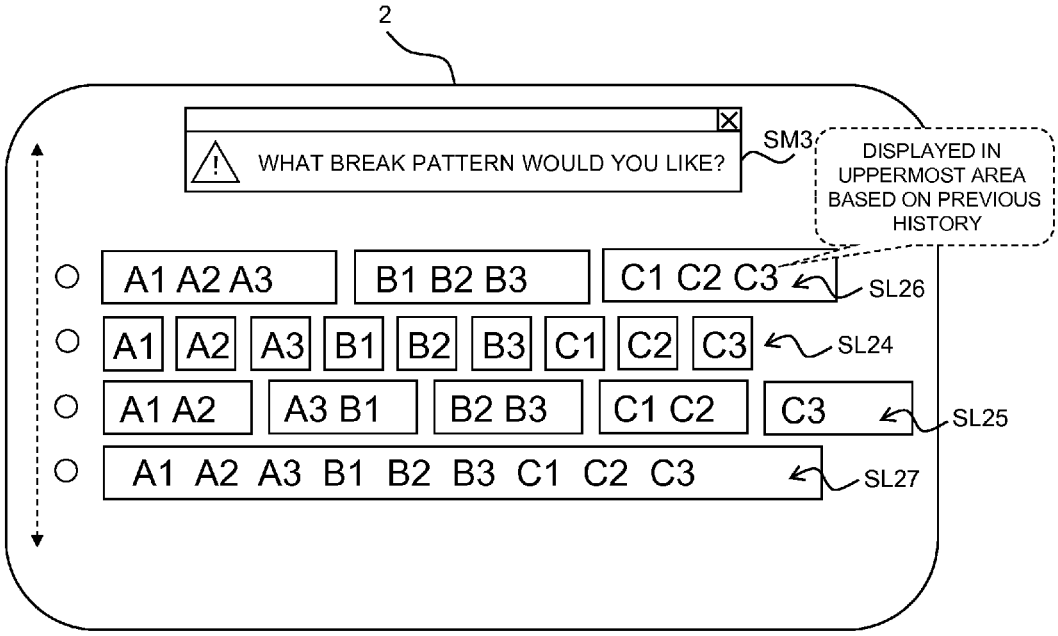
FIG. 14 is an explanatory view showing a display example of label images that use a plurality of types of break patterns in a modification where the break patterns are displayed with priority in accordance with history.

For example, FIG. 14 shows a case where the label image SL26, the label image SL24, the label image SL25, and the label image SL27 are displayed in that order from the upper area to the lower area in accordance with the selection history described using the FIG. 10A (the pattern corresponding to the label image SL26 of the four break patterns was selected).

In this modification, the break patterns that the operator utilized in the past are thereafter displayed with a higher priority than the other patterns on the preview screen of the liquid crystal display part 2. As a result, the operator can easily select the break pattern once again, thereby improving operator convenience in this manner as well.

Further, the arrows shown in the FIG. 5 denote an example of signal flow, but the signal flow direction is not limited thereto.

Also note that the present disclosure is not limited to the steps shown in the flowchart of FIG. 11 and FIG. 12; step additions and deletions as well as sequence changes may be made without deviating from the spirit and scope of the disclosure.

Further, other than that already stated above, techniques based on the above described embodiment and the like may be suitably utilized in combination as well.

What is claimed is:

1. A printer comprising:

a feeder configured to feed a print-receiving tape;

a printing head configured to produce at least one printed matter wherein a desired print object is respectively formed on said print-receiving tape, along a transport direction of said feeder, by performing printing of said print object on said print-receiving tape fed by said feeder;

a print object receiving portion configured to receive an input operation of said print object comprising a print identifier that can be incremented in accordance with a predetermined regularity and is respectively disposed in a plurality of blocks that can be set in a plurality in a tape length direction in relation to one said printed matter;

a setting image generating portion configured to generate a setting image in relation to said printed matter wherein said plurality of blocks, each comprising said print object, is arranged in a tape length direction, based on a reception result of said print object receiving portion;

a setting display portion configured to display said setting image generated by said setting image generating portion;

a first increment mode receiving portion configured to receive a setup operation of specification of at least one said print identifier to be incremented, an increment interval, and an increment execution count when said print identifier is to be incremented;

a first image generating portion configured to respectively generate first printed matter images wherein said print identifier is incremented in accordance with a setup operation received by said first increment mode receiving portion, using a plurality of different types of increment patterns;

a first display portion configured to display in list format said first printed matter images using said plurality of types of increment patterns, generated by said first image generating portion;

a second increment mode receiving portion configured to receive a selection operation of any one of said plurality of types of increment patterns in relation to said first printed matter images displayed in said list format;

a second image generating portion configured to respectively generate second printed matter images wherein said print identifier is incremented in accordance with the setup operation received by said first increment mode receiving portion and for which is used a type of increment pattern received by said second increment mode receiving portion, using a plurality of different types of assignment patterns when the print objects are to be assigned to each printed matter;

a second display portion configured to display in list format said second printed matter images using said plurality of types of assignment patterns, generated by said second image generating portion;

a third increment mode receiving portion configured to receive a selection operation of any one of said plurality of types of assignment patterns in relation to said second printed matter images displayed in said list format; and a printing control portion configured to control said feeder and said printing head so as to generate at least one said printed matter corresponding to said second printed matter images using said selected assignment pattern, in accordance with said selection operation received by said third increment mode receiving portion.

2. The printer according to claim 1, wherein:

said first image generating portion generates, at least, said first printed matter images that use a synchronizing pattern wherein said plurality of said print identifiers are incremented in synchronization, and said first printed matter images that use an alternating pattern wherein said plurality of said print identifiers are individually incremented alternately, respectively; and said first display portion displays, at least, said first printed matter images that use said synchronizing pattern, and said first printed matter images that use said alternating pattern, in list format.

3. The printer according to claim 1, further comprising a first history memory configured to store said selection operation of said one type of increment pattern received by said second increment mode receiving portion at the time of production of said at least one printed matter as first pattern selection history, in accordance with the fact that said at least one printed matter corresponding to said second printed matter images has been produced by said printing control portion; wherein:

said first display portion displays said first printed matter images by a priority order mode corresponding to said first pattern selection history stored by said first history memory when said first printed matter images are displayed for producing new said printed matter.

4. The printer according to claim 1, further comprising a second history memory configured to store said selection operation of said one type of assignment pattern received by said third increment mode receiving portion at the time of production of said at least one printed matter as second pattern selection history, in accordance with the fact that said at least one printed matter corresponding to said second printed matter images has been produced by said printing control portion; wherein:

said second display portion displays said second printed matter images by a priority order mode corresponding to said second pattern selection history stored by said second history memory when said second printed matter images are displayed for producing new said printed matter.

5. A non-transitory computer-readable recording medium, storing a printing control program for executing steps on a computer of a printer that comprises a feeder configured to feed a print-receiving tape, and a printing head configured to perform printing of a desired print object on said print-receiving tape fed by said feeder and that is configured to produce at least one printed matter wherein said print object is respectively formed on said print-receiving tape, along a transport direction of said feeder, said steps comprising:

a print object receiving step for receiving an input operation of said print object comprising a print identifier that can be incremented in accordance with a predetermined regularity and is respectively disposed in a plurality of blocks that can be set in a plurality in a tape length direction in relation to one said printed matter;

a setting image generation step for generating a setting image in relation to said printed matter wherein said plurality of blocks, each comprising said print object, is arranged in a tape length direction, based on a reception result in said print object receiving step;

a setting displaying step for displaying said setting image generated in said setting image generating step;

a first increment mode receiving step for receiving a setup operation of specification of at least one said print identifier to be incremented, an increment interval, and an increment execution count when said print identifier is to be incremented;

a first image generating step for respectively generating first printed matter images wherein said print identifier is incremented in accordance with a setup operation received in said first increment mode receiving step, using a plurality of different types of increment patterns;

a first displaying step for displaying in list format said first printed matter images using said plurality of types of increment patterns, generated in said first image generating step;

a second increment mode receiving step for receiving a selection operation of any one of said plurality of types of increment patterns in relation to said first printed matter images displayed in said list format;

a second image generating step for respectively generating second printed matter images wherein said print identifier is incremented in accordance with the setup operation received in said first increment mode receiving step and for which is used a type of increment pattern received in said second increment mode receiving step, using a plurality of different types of assignment patterns when the print objects are to be assigned to each printed matter;

a second displaying step for displaying in list format said second printed matter images using said plurality of types of assignment patterns, generated in said second image generating step;

a third increment mode receiving step for receiving a selection operation of any one of said plurality of types of assignment patterns in relation to said second printed matter images displayed in said list format; and a printing control step for controlling said feeder and said printing head so as to generate at least one said printed matter corresponding to said second printed matter images using said selected assignment pattern, in accordance with said selection operation received in said third increment mode receiving step.

6. A printing method executed by a printer that comprises a feeder configured to feed a print-receiving tape, and a printing head configured to perform printing of a desired print object on said print-receiving tape fed by said feeder, and that is configured to produce at least one printed matter wherein said print object is respectively formed on said print-receiving tape, along a transport direction of said feeder, said steps comprising:

a print object receiving step for receiving an input operation of said print object comprising a print identifier that can be incremented in accordance with a predetermined regularity and is respectively disposed in a plurality of blocks that can be set in a plurality in a tape length direction in relation to one said printed matter;

a setting image generation step for generating a setting image in relation to said printed matter wherein said plurality of blocks, each comprising said print object, is arranged in a tape length direction, based on a reception result in said print object receiving step;

a setting displaying step for displaying said setting image generated in said setting image generating step;

a first increment mode receiving step for receiving a setup operation of specification of at least one said print identifier to be incremented, an increment interval, and an increment execution count when said print identifier is to be incremented;

a first image generating step for respectively generating first printed matter images wherein said print identifier is incremented in accordance with a setup operation received in said first increment mode receiving step, using a plurality of different types of increment patterns;

a first displaying step for displaying in list format said first printed matter images using said plurality of types of increment patterns, generated in said first image generating step;

a second increment mode receiving step for receiving a selection operation of any one of said plurality of types of increment patterns in relation to said first printed matter images displayed in said list format;

a second image generating step for respectively generating second printed matter images wherein said print identifier is incremented in accordance with the setup operation received in said first increment mode receiving step and for which is used a type of increment pattern received in said second increment mode receiving step, using a plurality of different types of assignment patterns when the print objects are to be assigned to each printed matter;

a second displaying step for displaying in list format said second printed matter images using said plurality of types of assignment patterns, generated in said second image generating step;

a third increment mode receiving step for receiving a selection operation of any one of said plurality of types of assignment patterns in relation to said second printed matter images displayed in said list format; and a printing control step for controlling said feeder and said printing head so as to generate at least one said printed matter corresponding to said second printed matter images using said selected assignment pattern, in accordance with said selection operation received in said third increment mode receiving step.

* * * * *